US010477934B2

(12) United States Patent
Joyce

(10) Patent No.: US 10,477,934 B2
(45) Date of Patent: Nov. 19, 2019

(54) HAIR RETAINING DEVICE AND METHOD OF USING SAME

(71) Applicant: Genice Joyce, North Richland Hills, TX (US)

(72) Inventor: Genice Joyce, North Richland Hills, TX (US)

( * ) Notice: Subject to any disclaimer, the term of this patent is extended or adjusted under 35 U.S.C. 154(b) by 684 days.

(21) Appl. No.: 15/206,450

(22) Filed: Jul. 11, 2016

(65) Prior Publication Data

US 2017/0150795 A1 Jun. 1, 2017

Related U.S. Application Data

(60) Provisional application No. 62/260,575, filed on Nov. 29, 2015.

(51) Int. Cl.
*A45D 8/12* (2006.01)
*A45D 8/02* (2006.01)
*A45D 8/00* (2006.01)

(52) U.S. Cl.
CPC ..... *A45D 8/02* (2013.01); *A45D 2008/004* (2013.01)

(58) Field of Classification Search
CPC ..... A45D 8/02; A45D 8/06; A45D 2008/002; A45D 2008/004; A45D 2008/006
USPC ..... 132/208, 270, 273, 275, 278
See application file for complete search history.

(56) References Cited

U.S. PATENT DOCUMENTS

| | | | | | |
|---|---|---|---|---|---|
| 1,377,408 | A * | 5/1921 | Dies | A45D 8/08 | 132/283 |
| 5,271,421 | A * | 12/1993 | Videtzky | A45D 8/00 | 132/200 |
| 5,458,109 | A * | 10/1995 | Tu | A45D 8/24 | 132/278 |
| 5,682,908 | A * | 11/1997 | Chou | A45D 8/12 | 132/276 |
| 6,609,525 | B2 * | 8/2003 | Potter | A45D 8/04 | 132/276 |
| 7,222,630 | B2 | 5/2007 | Silva | | |
| D635,297 | S * | 3/2011 | Hsu | D28/39 | |
| 9,439,481 | B1 * | 9/2016 | Pfaff | A44C 7/005 | |
| 2007/0175493 | A1 * | 8/2007 | Tandberg | A45D 8/36 | 132/275 |
| 2008/0099036 | A1 | 5/2008 | Crowley et al. | | |
| 2011/0005547 | A1 * | 1/2011 | Tsai | A45D 8/08 | 132/275 |
| 2016/0100665 | A1 * | 4/2016 | Fetman | A45D 8/34 | 132/275 |

* cited by examiner

*Primary Examiner* — Nicholas D Lucchesi
(74) *Attorney, Agent, or Firm* — Whitaker Chalk Swindle & Schwartz PLLC; Charles Gunter

(57) ABSTRACT

A hair retaining device comprising a rod with two elongate helical coils surrounding a portion of the rod. The coils are attached only at one end of the rod and are offset from one another by 180 degrees. In use, the end of the rod is slid through a desired hair style using a weaving motion to pick up small portions of the hair. Once the rod is in place, it is screwed into a user's hair and the hair strands are retained. To remove the device, the rod is unscrewed to loosen from the hair strands and the rod is then pulled out of user's hair.

12 Claims, 11 Drawing Sheets

HAIR RETAINING DEVICE AND METHOD OF USING SAME

CROSS REFERENCE TO RELATED APPLICATIONS

This application claims priority from a provisional application, Ser. No. 62/260,575, filed Nov. 29, 2015, entitled "Hair Retaining Device and Method of Using Same" by the same inventor.

BACKGROUND OF THE INVENTION

Field of the Invention

This invention relates generally to a device for the retention of hair and methods for using the device in restraining hair, particularly human hair.

Background of the Invention

Devices for holding or ornamenting hair are well known. There are numerous different types of hair retaining devices such as hair sticks, hair pins, clips, barrettes, and bands used to retain the hair in a particular style. Early Greeks, Romans, and Egyptians used hair sticks. Hair pins such as bobby pins became popular in the 1920's. During the middle to later part of the $20^{th}$ century, clips, barrettes, and bands became common hair retaining devices.

Prior art devices used to retain hair generally suffer from one or more disadvantages. Hair sticks do not stay properly in the hair and hair which is meant to be retained by the device works its way loose and the arrangement becomes unsightly. Hair pins are usually not meant to be seen and they do not typically hold large bundles of hair. Clips are used to clamp or grip onto the hair and can crease or damage hair. Barrettes and bands tend to stress the hair in an unacceptable manner and may cause hair to break.

U.S. Pat. No. 5,271,421 to Videtsky describes a hair restraining device consisting of two joined coaxial circular coils. The device is screwed into user's hair to retain a desired hairstyle. An alternative embodiment of Videtsky, shown in FIG. 6 thereof, consists of one circular helical coil and a straight section retaining piece. This device is generally hidden from view when it is in use.

German patent DE 2020 09002649 to Meister describes a hair stick wherein the end pieces can be removed to create interchangeable decorations while using one hair stick base.

U.S. patent application US2005/0284496 from Maples-Andrade et al. describes a hair stick with a removable insertion. The insertion can be scented. Neither the German reference nor the device shown in this U.S. publication increase the ability of the hair stick to hold the hair in place.

U.S. Pat. No. 7,222,630 to Silva describes two hair sticks that are fastened to each other and which use a bead to hold the hair and the hair sticks in place. This device relies on moving a bead to capture the hair. The potential hairstyles and configuration of the hair sticks are limited since these hair sticks are fastened to each other and are used together.

I have found that hairpins are usually not meant to be seen and are not decorative in appearance and that hair sticks often slip out of hair, are difficult to use, and do not maintain the desired hairstyle.

Thus, despite various advances in the hair retention arts, there exists a need for a hair stick that stays properly in the hair, is easy to use, and is simple to remove.

SUMMARY OF THE INVENTION

The device of the present invention comprises a hair retaining device for decorating, constraining, and shaping a bundle of hair, typically human hair. In one form, the device comprises a centrally located rod with two elongate helical coils surrounding at least a portion of the rod. The centrally located rod has a proximal end and an oppositely arranged distal end. The pair of helical coils are angularly offset by 180 degrees and are connected at one end to the centrally located rod at an attachment point which is located a short distance from the proximal end of the rod. The pair of helical coils each also have an opposite, free end, which is not attached to the rod.

The centrally located rod may have an ornamental object attached to either or both of the proximal and distal ends. Both the rod and coils may be uniform in pitch and diameter along their length, or may be of variable pitch and/or variable diameter. The rod and coils can be manufactured from any convenient shape retaining rigid, semi-rigid, flexible material, or a combination thereof and may be made of ornamental metal, plastic, wood, or the like.

In another version of the invention, the device consists of two elongate helical coils which are again angularly offset by 180 degrees, but which are supported at one end from a rod-like handle portion rather than being attached to a centrally located rod. The rod-like handle portion may include decorative features.

To use the device, one first puts the hair in the desired configuration for the desired hairstyle. Next, holding the hair retention device adjacent to the hair, the device is inserted in a weaving motion to pick up small portions of the hair. Once the hair retention device is woven into the hair, it is screwed into the user's hair and the hair is retained. To remove the device, one simply unscrews the device to loosen it from the hair and the device is then pulled out away from hair. The proximal and distal ends of the rod are typically visible in the user's hair in most cases.

Accordingly, the reader will see that the various embodiments of this hair retention device can be easily used to retain a bundle of hair in a desired style and can be removed just as easily without damaging user's hair. In addition, when the device is placed in user's hair, it does not slip out of place. Since the rod is meant to be seen, it can provide an enhanced ornamental appearance to the hairstyle.

Furthermore, it has the additional advantages that:

- it is easy to manufacture
- it can be further decorated or embellished
- it may become a means for attaching other ornaments or decorative items
- it can be manufactured in different lengths and sizes to accommodate various hair lengths and thickness
- The hair retention device is of sufficient length to use in the hair and it may be plain, unadorned, decorated on the surface, or have an attractive ornamental appearance.
- Additionally, hair retention device may become a means for attaching other ornaments or decorative items.

Additional objects, features and advantages will be apparent in the written description which follows.

DETAILED DESCRIPTION OF THE INVENTION

Embodiments of the invention presented in the following written description and the various features and advantageous details thereof are explained more fully with reference to the non-limiting examples included and as detailed in the description which follows. Descriptions of well-known components and processes and manufacturing techniques are omitted so as to not unnecessarily obscure the principal features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

Figure 1A:
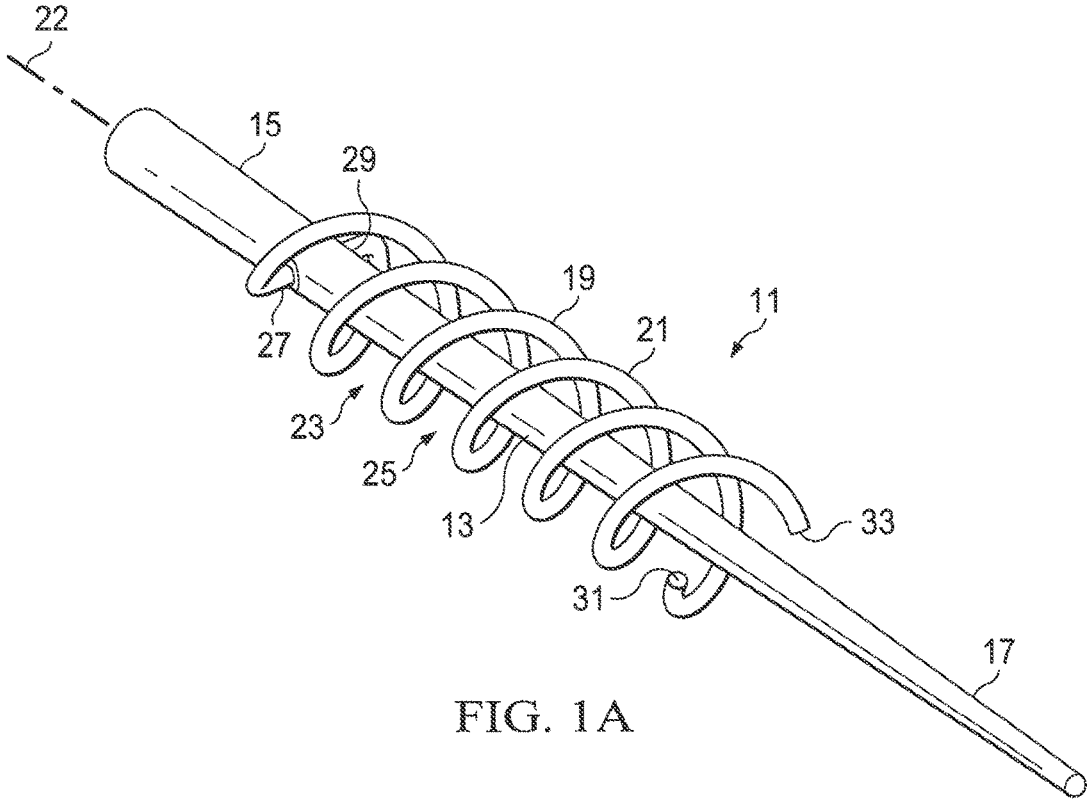
FIG. 1A is a perspective view of one version of the hair retention device of the invention showing a centrally located rod with two elongated helical coils attached adjacent a proximal end of the rod with the helical coils surrounding the rod.
Figure 1B:
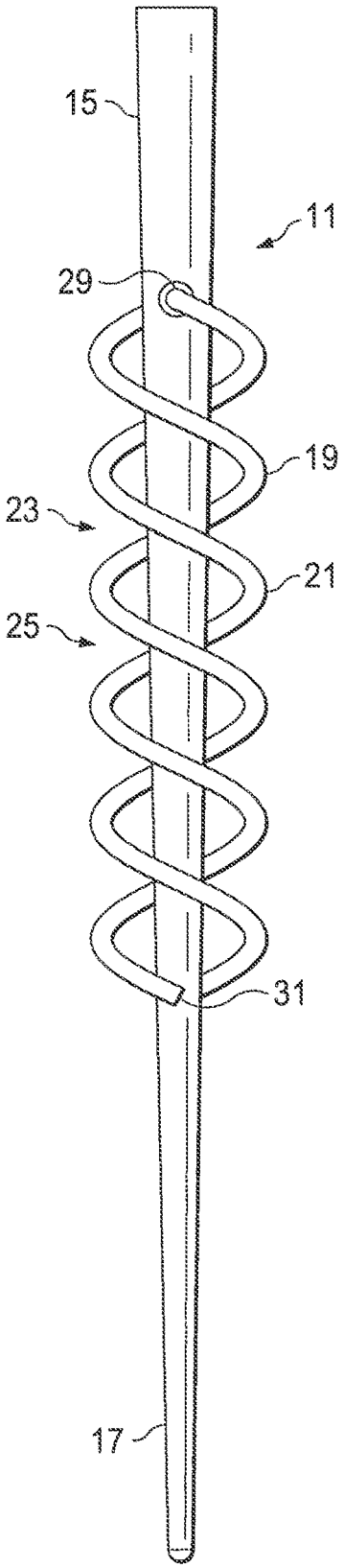
FIG. 1B is a side view of the embodiment of the invention shown in FIG. 1A.
Figure 1C:
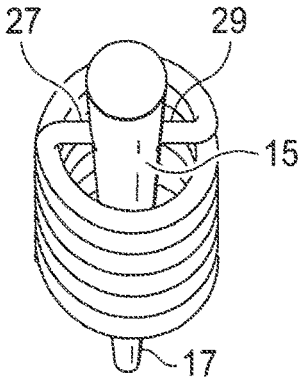
FIG. 1C is a top, end view of the embodiment of the invention shown in FIG. 1A.

A preferred version of the hair retaining device of the invention is illustrated in FIG. 1A (perspective view), FIG. 1B (side view), and FIG. 1C (top, end view). The hair retention device (designated generally as 11 in FIG. 1A) is comprised of a centrally located rod 13 which has a proximal end 15 and an oppositely arranged distal end 17 and a length therebetween. As will be appreciated from FIG. 1, the device of the invention also has two substantially identical helical coils 19, 21 which are permanently or semi-permanently attached to the centrally located rod. In the preferred form of the invention shown in FIG. 1A, the helical coils are offset from each other by 180 degrees with respect to a longitudinal axis (22 in FIG. 1A) of the centrally located rod 13. Gaps (such as the gaps located generally at 23, 25 in FIG. 1A) exist between the pair of helical coils to allow for holding hair. As shown in the perspective view of FIG. 1A, the helical coils are attached at one end (27, 29, in FIG. 1A, respectively) adjacent the proximal end 15 of the centrally located rod with the helical coils surrounding at least a portion of the length of the centrally located rod. Each of the helical coils also has an oppositely arranged end 31, 33 which is free in space and which is not attached to the centrally located rod. The free ends of the helical coils may be blunt or rounded to prevent scratching the user's head while device it inserted into the user's hair.

Both the centrally located rod and the helical coils can be uniform in pitch and diameter along their length or, alternatively, they can be of non-uniform pitch and diameter along their length. The centrally located rod and helical coils can be made from any number of commercially available materials, such as a conveniently available material selected from the group consisting of wood, metal, plastics, composite synthetics and combinations thereof.

As will be apparent from the discussion which follows, the centrally located rod can be decorative, for example, by attaching an ornamental object to either or both of the proximal and distal ends. The retention device can also be decorated on the surface in order to provide an attractive ornamental appearance. In some cases, the centrally located rod is provided with a receptacle for receiving an ornamental member.

Figure 2:
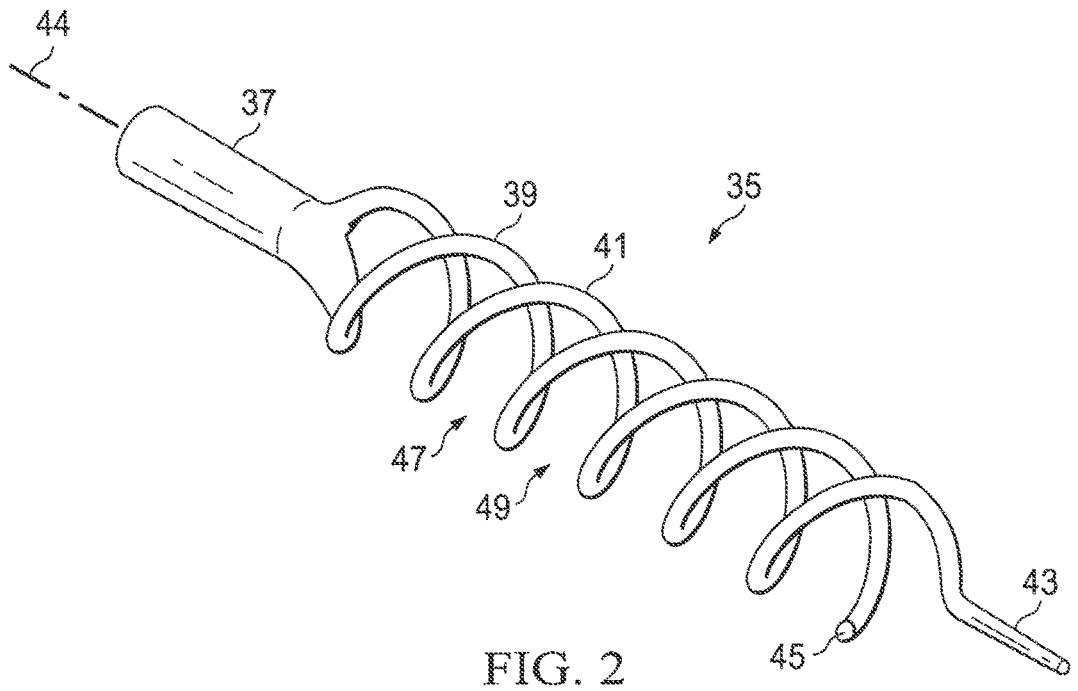
FIG. 2 is a perspective view of another version of the hair retention device of the invention which, in this case, has a rod-like handle portion which transforms into two helical coils extending away from a distal end of the handle portion of the device, wherein a distal end of a selected one of the helical coils transforms back into a linearly extending rod portion, the distal end of the remaining helical coil being free and spaced apart from the linearly extending rod portion.

FIG. 2 (perspective view) depicts a second embodiment of the hair retention device. In this case, the device (designated generally as 35 in FIG. 2) has an elongated, rod-like handle portion 37 which transforms into two substantially identical helical coils 39, 41 extending away from a distal end of the rod-like handle portion 37. As can be seen in FIG. 2, the distal end 43 of a selected one of the helical coils 41 transforms back into a linearly extending rod portion 43, the distal end of the remaining helical coil 45 being free and spaced apart from the linearly extending rod portion 43. The linearly extending rod portion 43 is generally aligned with the longitudinal axis 44 of the rod-like handle portion 37. The helical coils 39, 41 are preferably offset from one another by 180 degrees with respect to a longitudinal axis 44 of the rod-like handle portion 37. Gaps 47, 49 again exist between the helical coils to allow for holding hair. The end point of the helical coil with the free end 45 may be blunt or rounded to prevent scratching the user's head while device is inserted into the user's hair.

Figure 3:
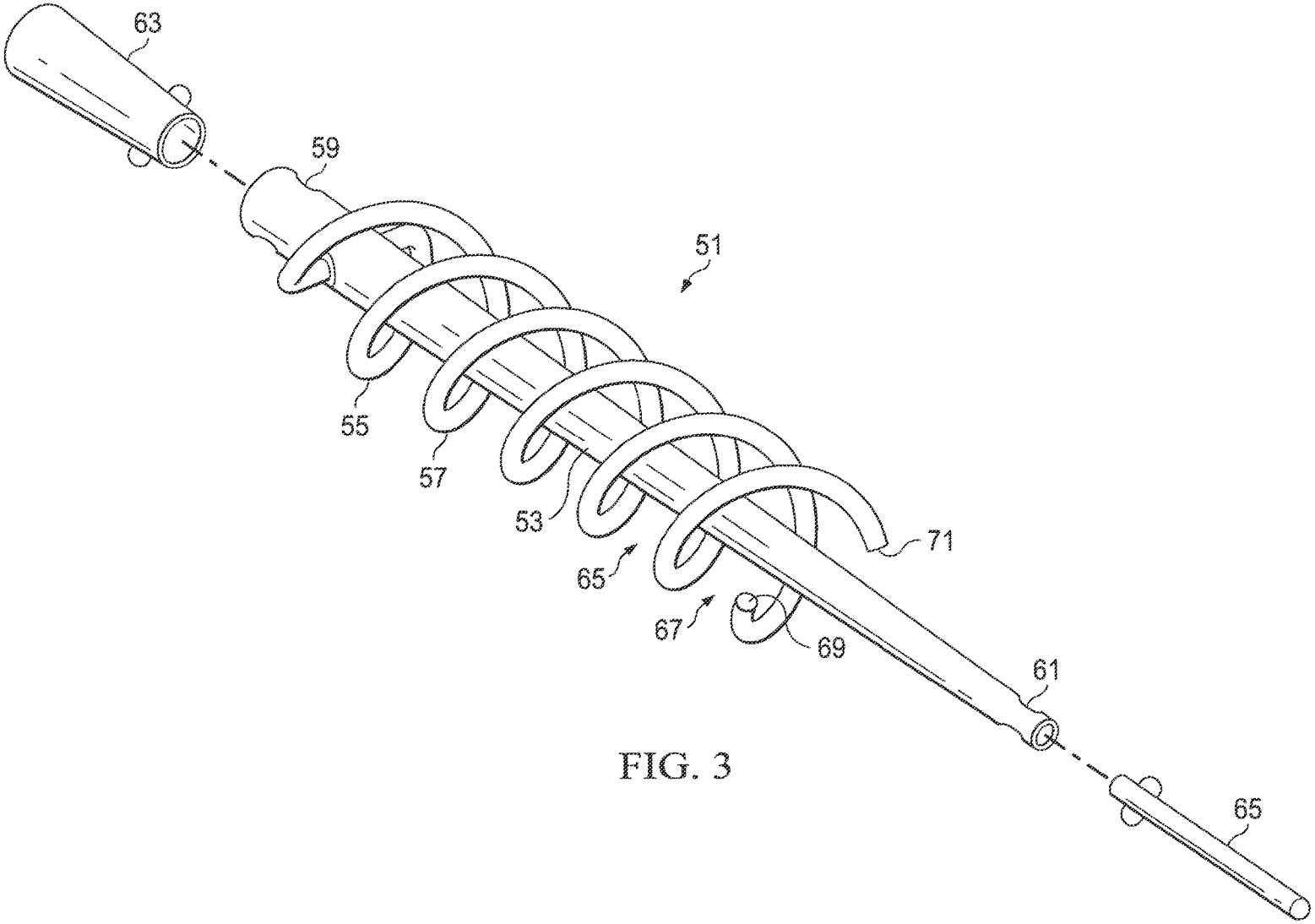
FIG. 3 is a perspective view of another version of the hair retention device of the invention showing a centrally located rod with a proximal end and a distal end, with two elongated helical coils attached adjacent the proximal end of the rod, with the helical coils surrounding the rod, and wherein the proximal and distal ends of the rod are removable and/or interchangeable.

FIG. 3 (perspective view), depicts another version of the hair retention device. Once again, the hair retention device 51 is comprised of a rod 53 and two substantially identical helical coils 55, 57. Unlike the version of the invention shown in FIG. 1A, however, the proximal and distal ends 59, 61 of the centrally located rod 53 have removable end attachments (such as the end attachments 63, 65). These attachments can include decorative features and can be easily and securely, removed, detached, and reattached by any convenient connecting mechanism from the remainder of the device. The connecting mechanism can be a screw connection, a magnetic connection, a bayonet catch connection, a simple plug connection, two male members, or another manner to enable rods to be detached and reattached. The helical coils are again preferably offset from each other by 180 degrees. Gaps 65, 67 again exist between the helical coils to allow for holding hair. The helical coils 55, 57 are attached adjacent a proximal end of the centrally located rod 53 with the coils surrounding the centrally located rod. End points 69, 71 of the helical coils are not attached to the rod. The free ends of the coils may be blunt or rounded to prevent scratching the user's head while device it inserted into the hair.

Figure 4:
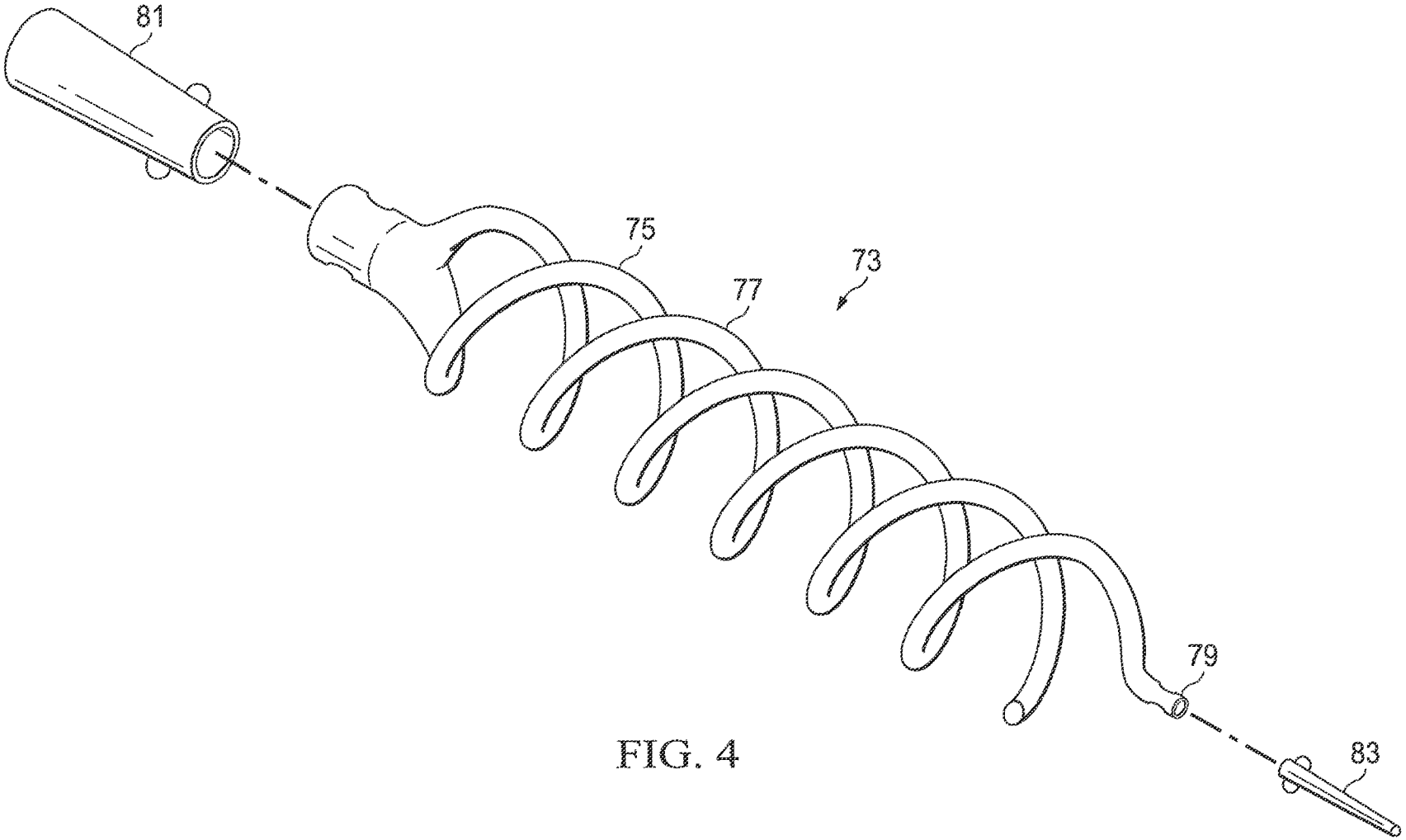
FIG. 4 is a perspective view of another version of the hair retention device with a rod-like handle portion that transforms into two helical coils extending away from a distal end of the handle portion of the device, wherein a distal end of a selected one of the helical coils transforms back into a linearly extending rod portion, the distal end of the remaining helical coils being free, spaced apart from the linearly extending rod portion, and wherein the rod-like handle portion and the linearly extending rod portion are removable and/or interchangeable.

FIG. 4 (perspective view) depicts another version of the hair retention device 73. This version of the device is substantially identical to that of FIG. 2 in that a handle like rod portion transforms into two substantially identical coils 75, 77, with one of the coil ends 79 again transforming back to a linear rod portion. In this case, however, the opposite ends 81, 83 of the device can be easily and securely, removed, detached, and reattached by a connecting mechanism of some type. The connection mechanism can conveniently be a screw connection, a magnetic connection, a bayonet catch connection, a simple plug connection, two male members, or another manner to enable rods to be detached and reattached.

Figure 5:
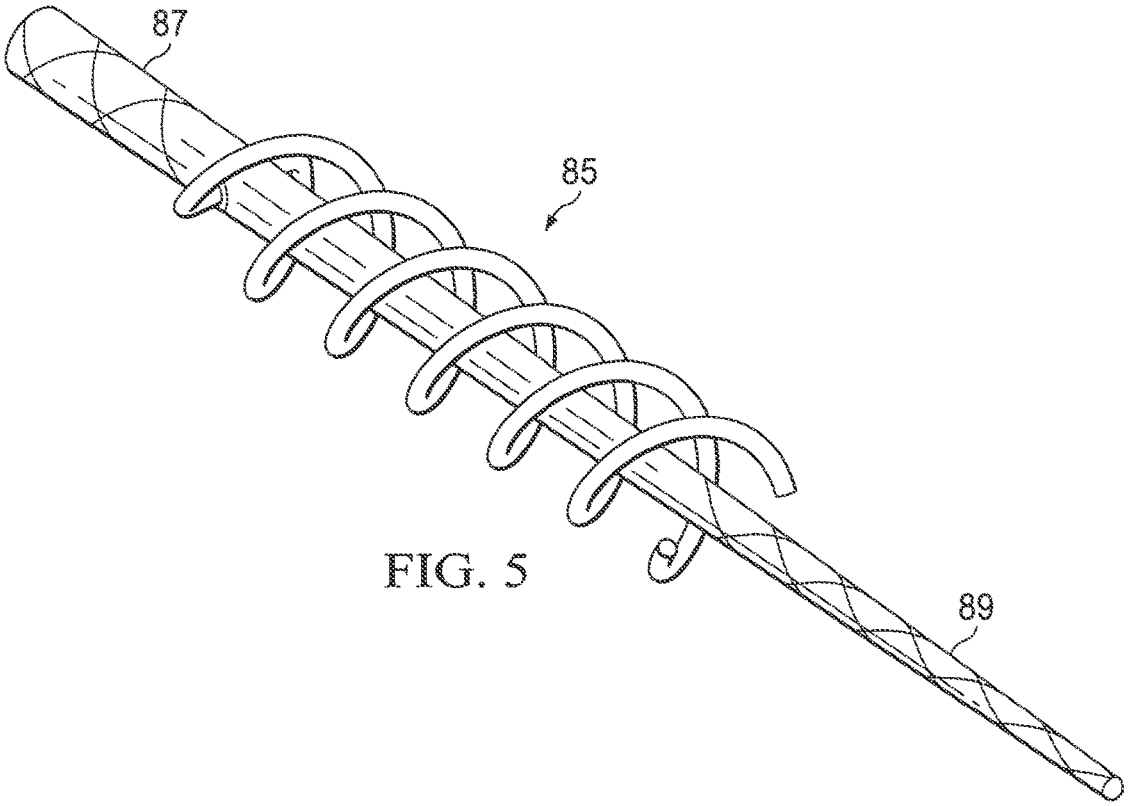
FIG. 5 is a perspective view of a device of the invention, similar to the device of FIG. 1, but in which an exterior surface of the centrally located rod is decorated or embellished in some manner.

FIG. 5 is a perspective view of the hair retention device 85, similar to the version of the invention shown in FIG. 1A, except that this version of the device has an external surface, at least a portion of which is decorated, as at the regions 87, 89 in FIG. 5.

Figure 6:
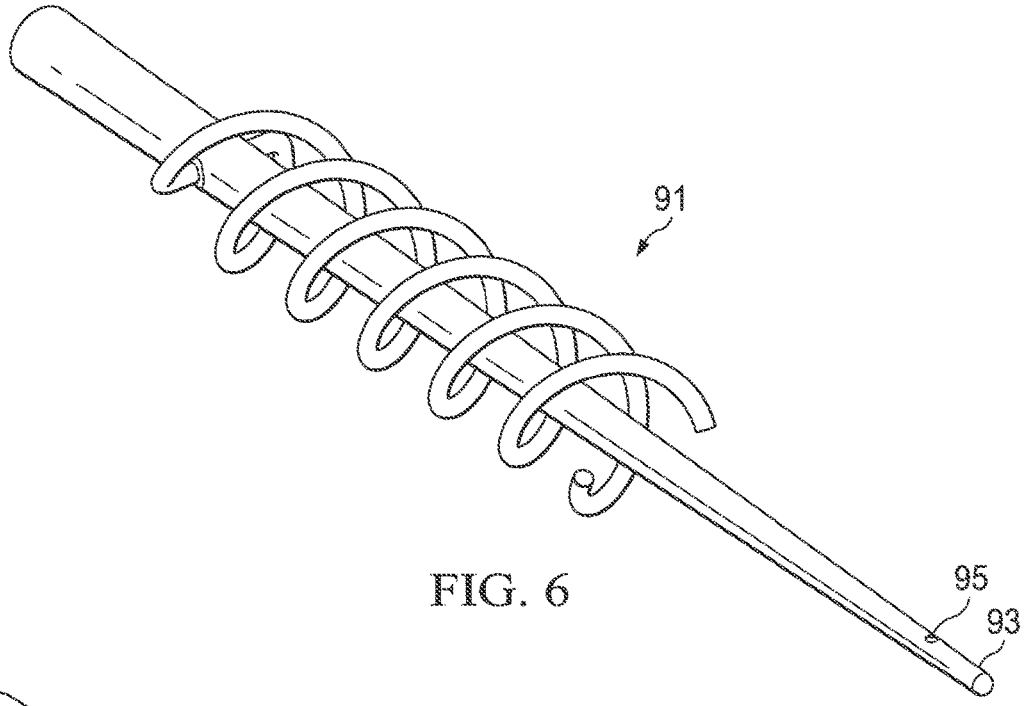
FIG. 6 is a perspective view of a device of the invention wherein the distal end of the centrally located rod is provided with a receptacle for an ornament.
Figure 6A:
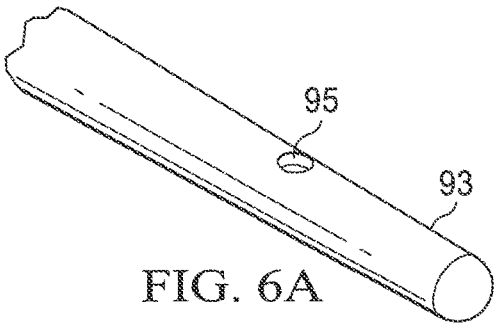
FIG. 6A is a perspective view of the distal end of the centrally located rod showing the receptacle for an ornament in enlarged fashion.
Figure 6B:
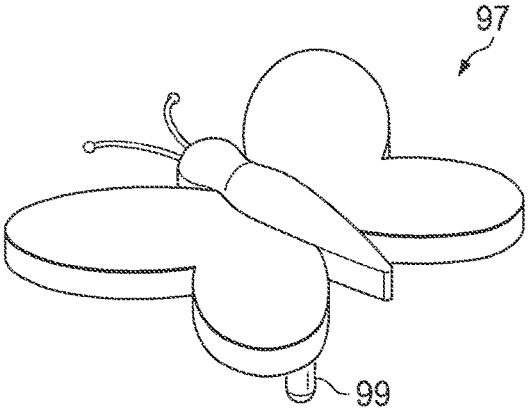
FIG. 6B is an isolated view of an exemplary ornament of the type having an attachment pin which would be received within the receptacle shown in FIG. 6A.

FIG. 6 is a perspective view of a device 91 of the invention wherein the distal end 93 of the centrally located rod being provided with a receptacle opening 95 for an ornament. FIG. 6A shows the receptacle opening 95 in enlarged fashion. FIG. 6B is an isolated view of an exemplary ornament, in this case a butterfly 97. The butterfly body is provided with a downwardly extending attachment pin 99 which would be received within the receptacle opening 95 shown in FIG. 6A.

Figure 7:
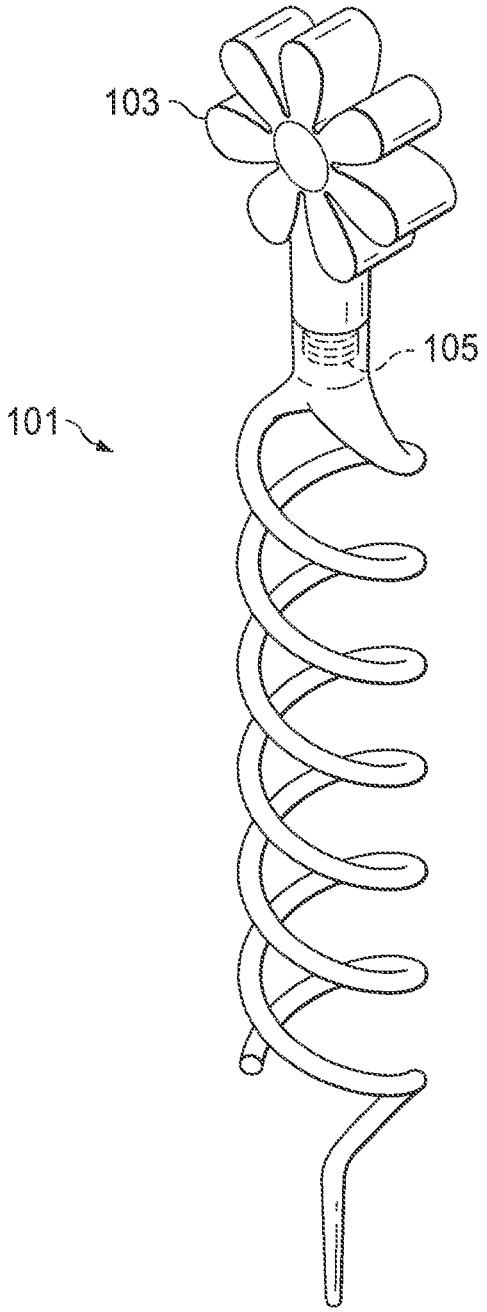
FIG. 7 is a perspective view of another device of the invention that includes an attached or removable/interchangeable decorative member.

FIG. 7 is a perspective view of another version of the device 101 of the invention that includes an attached or removable/interchangeable decorative member 103. In this case, the decorative member is a flower element. The removable/interchangeable decorative member 103, in the view shown in FIG. 7, has a threaded bolt which is received in mating fashion in a threaded bore 105.

Figure 8A:
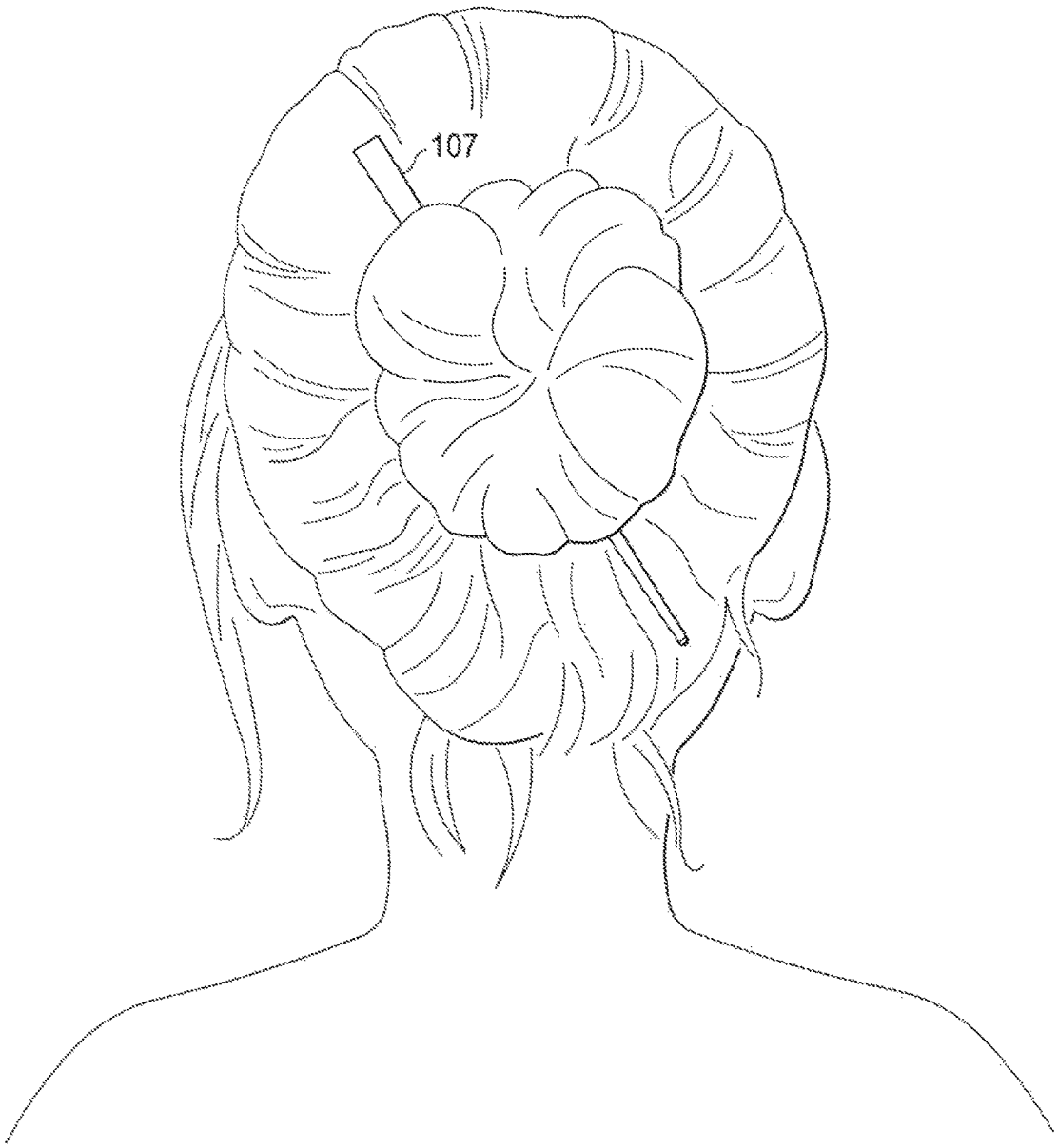
FIG. 8A is an example of the use of one of the devices of the invention in a user's hair.

FIG. 8A is an example of the use of one of the devices 107 of the invention in a user's hair.

Figure 8B:
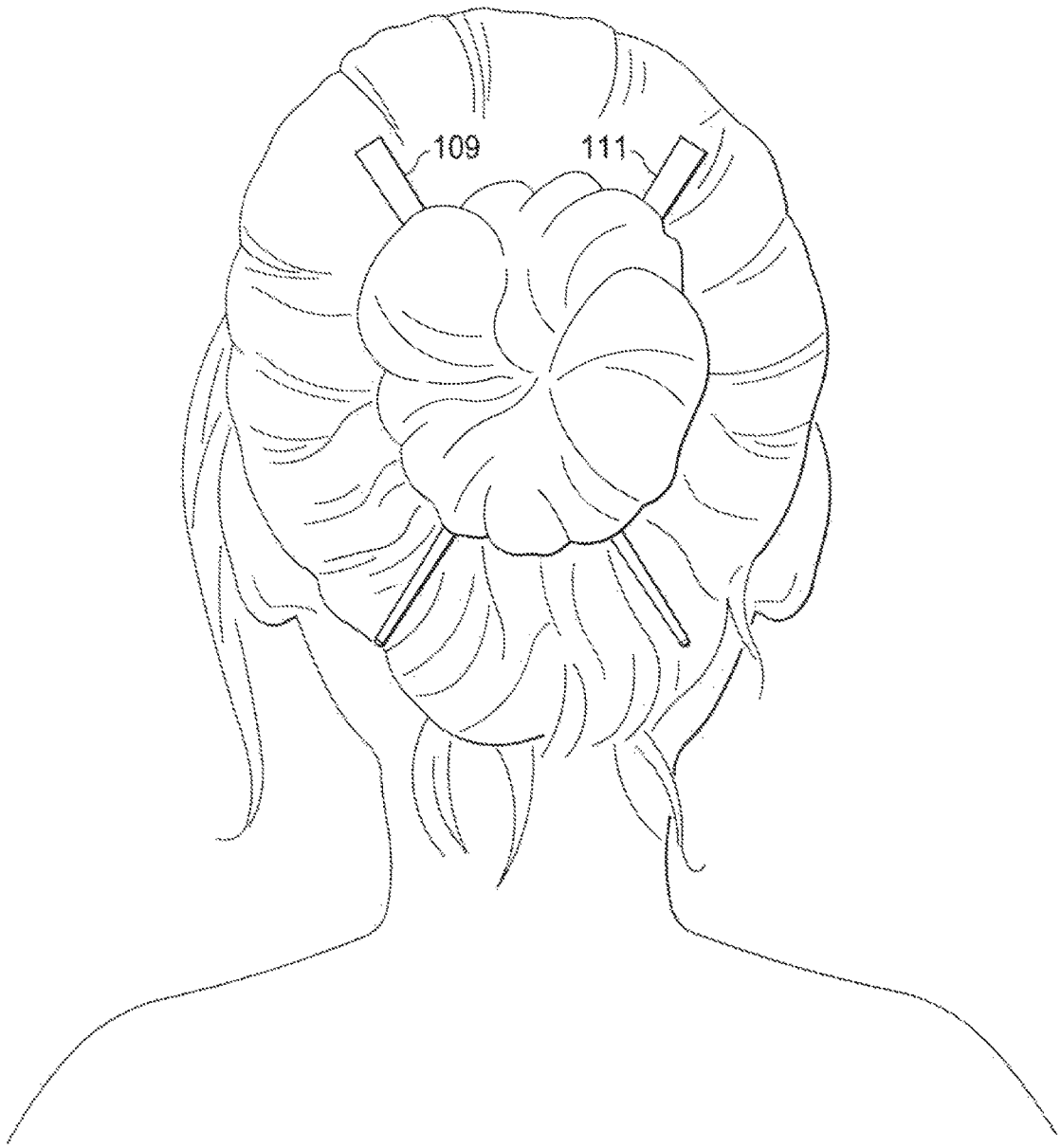
FIG. 8B is an example of two of the devices of the invention installed in a user's hair.

FIG. 8B is an example of two of the devices 109, 111 of the invention installed in a user's hair.

Figure 9:
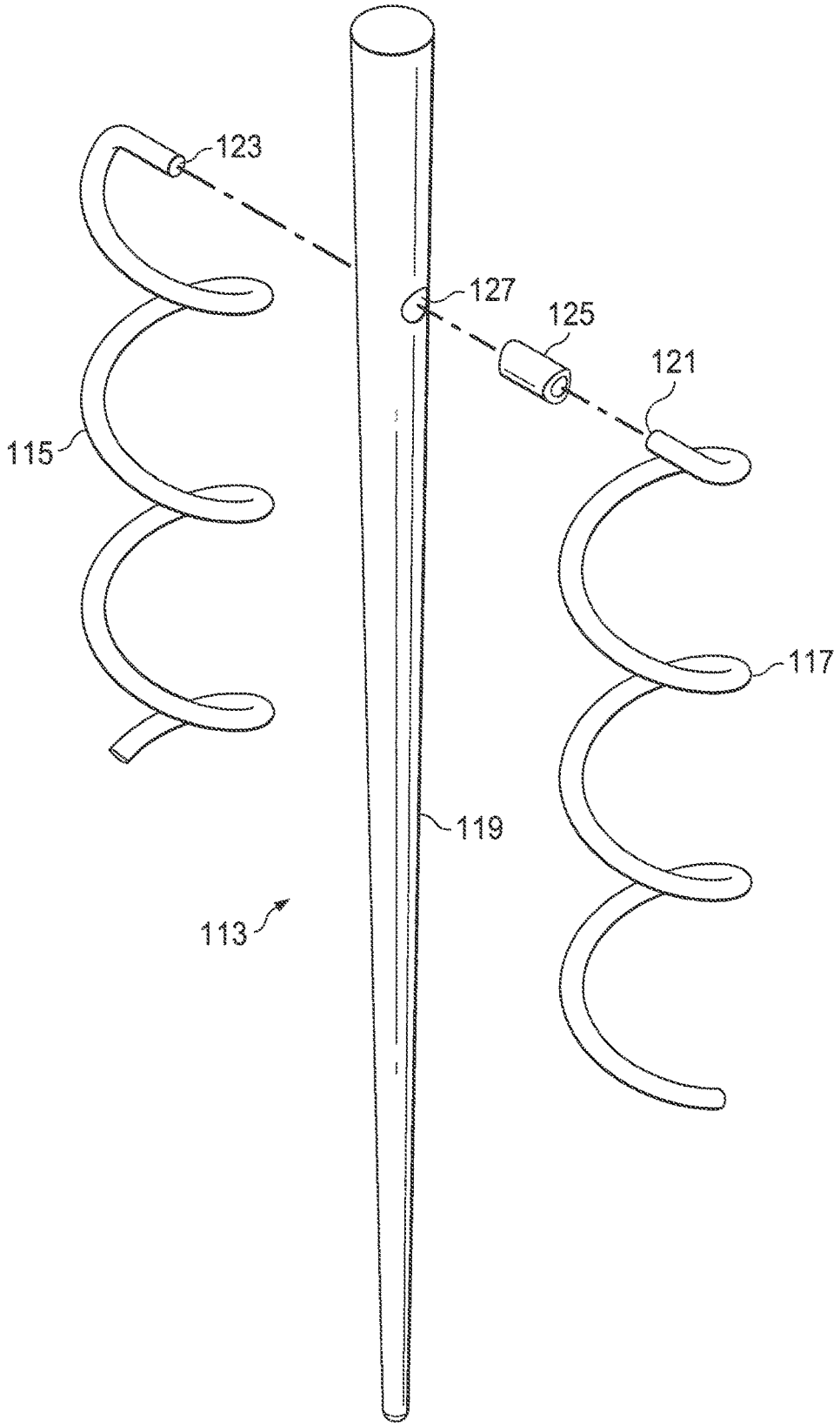
FIG. 9 is a perspective view of a device of the invention, similar to the device shown in FIG. 1, illustrating how the pair of helical coils are permanently or semi-permanently attached to the centrally located rod.

FIG. 9 is a perspective view of a device 113 of the invention, similar to the device shown in FIG. 1A, illustrating how the pair of helical coils 115, 117 are permanently or semi-permanently attached to the centrally located rod 119. In the example shown in FIG. 9, the coil ends 121, 123 are press-fit within a friction sleeve 125 which is received in a mating bore 127 provided in the body of the centrally located rod 119.

In all of the embodiments illustrated, the centrally located rod (such as rod 13 in FIG. 1A) must be of sufficient length to retain hair and it may be tapered at one or both ends. The inside diameter of the coils can be of any size relative to each other that are compatible with restraining bundles of hair. As has been explained, there must be sufficient gaps (such as gaps 23, 25 in FIG. 1A) in each spiral to retain hair in the desired style. Typically, this is at least 2.5 convolutions of the coils 2 to produce at least 5 such gaps. Both rod and coils may consist of rigid, semi-rigid, flexible material, or a combination thereof which retains its shape.

In use, one first puts the hair in the desired configuration for the desired hairstyle. Next, holding the hair retention device adjacent to the hair, one inserts the device in a weaving motion to pick up small portions of the hair. Once the hair retention device is woven into the hair, it is screwed into the user's hair and the hair is retained. To remove the device, one unscrews the device to loosen it from the hair and the device is then pulled out away from hair. The proximal and distal ends of the rod are visible in the user's hair in most cases. The device may be used with many different hairstyles and it is possible to employ more than one device. FIG. 8A displays one possible mode of using the device. FIG. 8B displays one possible mode of using two such devices.

An invention has been provided with several advantages. From the descriptions above, the advantages of the various described embodiments of my hair retention device become evident, including the following:

Retains user's hair in the desired style and stays properly in place.

(a) Easy to use and to remove.

(b) Provides an enhanced ornamental appearance.

(c) Decorative features and facilities to attach other decorations are possible.

(d) Further embellishments such as etching, engraving, or external designs may be added as decorative features.

(e) Device does not physically clamp, crimp, or stress user's hair and it will therefore not crease or damage user's hair, (f) Meant to be seen in hair not hidden.

(g) Simple to manufacture and has a minimum number of parts.

While the invention has been shown in several of its forms, it will be understood that it is not thus limited but may be subject to various changes and modifications without departing from the spirit thereof. For example, the rod can be different lengths or widths, tapering widths, uniform width, different girth, not symmetrical, or symmetrical; the coils can consist of few convolutions or many; the coils may be symmetrical, not symmetrical, or different girths or widths; there may be more than two coils; or device may glow in the dark.

What is claimed is:

1. A hair retention device, comprising:

a centrally located rod having a proximal end and an oppositely arranged distal end and a given length therebetween;

a pair of elongate helical coils surrounding at least a portion of the length of the centrally located rod, each of the coils in the pair of helical coils having two opposing ends, each coil being attached to the centrally located rod at one end at an attachment point which is located adjacent the proximal end of the rod and having an opposite, free end which is not attached to the centrally located rod;

the pair of elongate helical coils being angularly offset by 180 degrees with respect to a longitudinal axis of the centrally located rod.

2. The hair retention device of claim 1, wherein the helical coils of the retention device enable the hair retention device to be screwed into a human's hair to maintain a desired hairstyle, the device being removable from the hair by unscrewing it and pulling the centrally located rod out of the user's hair.

3. The hair retention device of claim 1, wherein the centrally located rod has an ornamental object attached to either or both of the proximal and distal ends.

4. The hair retention device of claim 1, wherein the centrally located rod and the helical coils are uniform in pitch and diameter along their length.

5. The hair retention device of claim 1, wherein the centrally located rod and the helical coils are of non-uniform pitch and diameter along their length.

6. The hair retention device of claim 1, wherein the centrally located rod and helical coils are made from a conveniently available material selected from the group consisting of wood, metal, plastics, synthetic composites and combinations thereof.

7. The hair retention device of claim 1 wherein said hair retention device is decorated on a surface and has an ornamental appearance.

8. The hair retention device of claim 1, wherein the centrally located rod is provided with a receptacle for receiving an ornamental member.

9. The hair retention device of claim 1, wherein either or both of the proximal end and oppositely arranged distal end of the centrally located rod are removable and/or interchangeable.

10. The hair retention device of claim 9, wherein the selected removable and/or interchangeable ends are connected by a connection mechanism selected from the group consisting of a screw connection, a magnetic connection, a bayonet catch connection, a simple plug connection and friction force fitting between two mating members.

11. The hair retention device of claim 1, wherein the helical coils have turns that are offset from one another to provide hair receiving gaps between the turns.

12. The hair retention device of claim 1, wherein the opposite, free opposing ends of the helical coils are blunt or rounded to prevent scratching a user's scalp.

* * * * *